US009926065B2

(12) United States Patent
Araki et al.

(10) Patent No.: US 9,926,065 B2
(45) Date of Patent: Mar. 27, 2018

(54) PERSONAL WATERCRAFT

(71) Applicant: Kawasaki Jukogyo Kabushiki Kaisha, Kobe-shi, Hyogo (JP)

(72) Inventors: Toshio Araki, Kakogawa (JP); Hironori Kato, Kakogawa (JP)

(73) Assignee: KAWASAKI JUKOGYO KABUSHIKI KAISHA, Kobe-shi, Hyogo (JP)

( * ) Notice: Subject to any disclaimer, the term of this patent is extended or adjusted under 35 U.S.C. 154(b) by 0 days.

(21) Appl. No.: 15/343,012

(22) Filed: Nov. 3, 2016

(65) Prior Publication Data

US 2017/0121005 A1 May 4, 2017

(30) Foreign Application Priority Data

Nov. 4, 2015 (JP) ..... 2015-216294

(51) Int. Cl.
*B63B 35/73* (2006.01)
*B63J 2/06* (2006.01)
*B63H 21/00* (2006.01)

(52) U.S. Cl.
CPC ..... *B63J 2/06* (2013.01); *B63B 35/731* (2013.01); *B63H 21/24* (2013.01)

(58) Field of Classification Search
CPC ..... B63B 35/731; B63H 21/24; B63J 2/06
See application file for complete search history.

(56) References Cited

U.S. PATENT DOCUMENTS 6,779,474 B2 8/2004 Nakagawa et al.
7,559,287 B2 * 7/2009 Tsumiyama ..... B63B 25/002 114/201 R

* cited by examiner

*Primary Examiner* — Stephen P Avila
(74) *Attorney, Agent, or Firm* — Alleman Hall Creasman & Tuttle LLP

(57) ABSTRACT

A personal watercraft comprises a body including a deck and a hull, the body being provided with an engine room; an engine disposed in the engine room; a maintenance opening provided in the deck and located above the engine to in such a manner that an outside region of the body is in communication with an interior of the engine room through the maintenance opening; at least one duct mounting hole provided in the deck at a location different from a location of the maintenance opening in such a manner that the outside region is in communication with the interior of the engine room through the duct mounting hole; at least one ventilation duct fitted to the duct mounting hole to guide air from the outside region to the engine room; and an engine hood covering the maintenance opening and an air inlet of the ventilation duct.

6 Claims, 3 Drawing Sheets

PERSONAL WATERCRAFT

CROSS-REFERENCE TO THE RELATED APPLICATION

This application claims priority to and the benefit of Japanese Patent Application No. 2015-216294 filed on Nov. 4, 2015, the entire disclosure of which is incorporated herein by reference.

BACKGROUND OF THE INVENTION

Field of the Invention

The present invention relates to a personal watercraft including a ventilation duct.

Description of the Related Art

In an exemplary jet-propulsive personal watercraft, an engine is disposed in an engine room surrounded by a hull and a deck, a water jet pump driven by the engine pressurizes water suctioned through a water suction port provided at the hull, and ejects the pressurized water in a rearward direction through a pump nozzle, thereby propelling of the watercraft (see U.S. Pat. No. 6,779,474). The deck is provided with a maintenance opening which is located above the engine and through which an operator performs a maintenance operation for the engine or the like. The maintenance opening is closed by an engine hood. The engine hood includes an inner panel and an outer panel. The outer panel is provided with a ventilation hole through which outside air is taken into the body. A ventilation duct is mounted to the inner panel. The ventilation duct is made of rubber and extends to the engine room. The outside air is introduced into the body through the ventilation hole and supplied to the engine room through the ventilation duct. This air is used as intake air for the engine.

However, in the above-described layout, in a case where the engine hood is demounted from the deck and mounted to the deck thereafter in a maintenance operation, it is necessary to mount the engine hood to the deck with a great care while preventing a situation in which the ventilation duct extending downward from the engine hood interferes with the engine or a member located in the vicinity of the engine and is bent, and thereby an air passage of the ventilation duct is closed.

In view of the above-described circumstances, an object of the present invention is to more easily perform a maintenance operation in a case where an engine hood is demounted from and mounted to a deck in a personal watercraft including a ventilation duct.

SUMMARY OF THE INVENTION

According to an aspect of the present invention, a personal watercraft comprises a body including a deck and a hull, the body being provided with an engine room in an interior of the body; an engine disposed in the engine room; a maintenance opening provided in the deck and located above the engine in such a manner that an outside region of the body is in communication with an interior of the engine room through the maintenance opening; at least one duct mounting hole provided in the deck at a location that is different from a location of the maintenance opening in such a manner that the outside region of the body is in communication with the interior of the engine room through the at least one duct mounting hole; at least one ventilation duct fitted to the at least one duct mounting hole to guide air from the outside region of the body to the engine room; and an engine hood covering the maintenance opening and an air inlet of the at least one ventilation duct.

In accordance with this configuration, the duct mounting hole is provided in the deck at the location different from the location of the maintenance opening. Therefore, the engine hood can be demounted from and mounted to the deck while maintaining a state in which the ventilation duct is mounted to the deck. This allows an operator to easily carry out a maintenance operation. In addition, since the air inlet of the ventilation duct is covered by the engine hood covering the maintenance opening, entry of the water from the outside region of the body into the ventilation duct can be prevented effectively.

The above and further objects, features and advantages of the present invention will more fully be apparent from the following detailed description of preferred embodiment with accompanying drawings.

DETAILED DESCRIPTION OF THE EMBODIMENTS

Hereinafter, the embodiment of the present invention will be described with reference to the accompanying drawings. The stated directions are from the perspective of a rider riding in a personal watercraft 1.

Figure 1:
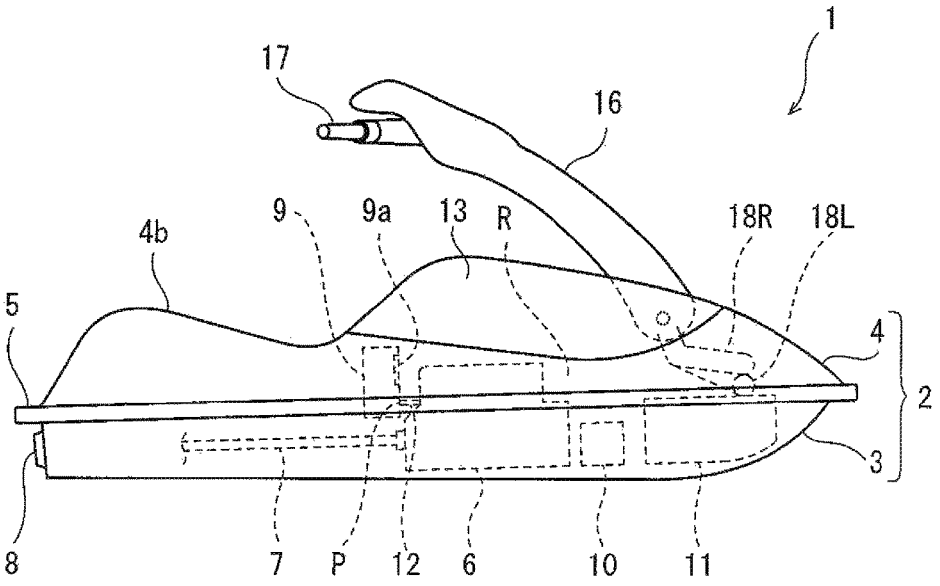
FIG. 1 is a side view of a personal watercraft according to the embodiment of the present invention.
Figure 2:
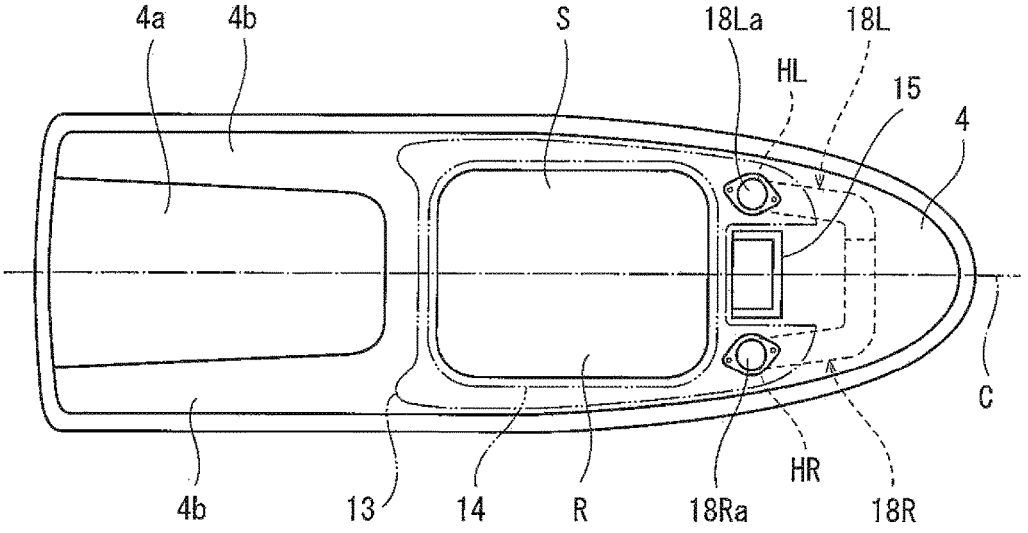
FIG. 2 is a plan view of the personal watercraft of FIG. 1, in a state in which a handle pole and an engine hood are demounted from a deck of the watercraft.

As shown in FIGS. 1 and 2, the personal watercraft 1 is a stand-up type personal watercraft which can be steered by the rider in a standing position. The personal watercraft 1 includes a body 2 provided with an engine room R in the interior thereof. The body 2 includes a hull 3 and a deck 4 covering the hull 3 from above. A connection line at which the hull 3 and the deck 4 are connected to each other is called a gunnel line 5. An engine 6 is disposed in the engine room R. A propeller shaft 7 extends rearward through the interior of the body 2, and the front end of the propeller shaft 7 is connected to the output shaft of the engine 6. A water jet pump (not shown) is driven by the propeller shaft 7 to pressurize and accelerate water suctioned through a suction port provided at the hull 3, and ejects the water through a jet nozzle 8 attached to the rear end portion of the body 2. In this way, a propulsive force for moving the body 2 is generated.

In the engine room R, an air cleaner 9, a battery 10, a fuel tank 11, and the like are disposed, as well as the engine 6. The air cleaner 9 is connected to the intake port of the engine 6 via an air-intake pipe 12. The air cleaner 9 is disposed rearward relative to the engine 6. In other words, the air cleaner 9 is located at the rear portion of the engine room R. The air cleaner 9 is provided with a suction opening 9*a* through which the air present in the interior of the engine room R is suctioned into the air cleaner 9. An air flow passage extending from the air cleaner 9 to the engine 6 via the air-intake pipe 12 is an air-intake passage P through which the air is led from the interior of the engine room R to the engine 6, and the suction opening 9*a* of the air cleaner 9 is a suction opening of the air-intake passage P. The suction opening 9*a* is located rearward relative to the engine 6 in the interior of the engine room R. It should be noted that the suction opening 9*a* is located to be higher than the gunnel line 5.

The battery 10 is configured to store therein electric power to be supplied to electric components such as a controller (not shown) which controls the operation of a starter motor (not shown) for starting the engine 6, and the operation of the engine 6. The battery 10 is disposed in front of the engine 6. The fuel tank 11 is configured to reserve (store) therein fuel to be supplied to the combustion chamber of the engine 6. The fuel tank 11 is disposed in front of the engine 6 and the battery 10. In other words, the fuel tank 11 is located at the front portion of the engine room R.

At the rear portion of the deck 4, a standing deck 4*a* is disposed rearward relative to the engine room R. The standing deck 4*a* has a flat floor surface on which the rider stands. The standing deck 4*a* is located to be lower than the upper end of the engine room R. Deck fins 4*b* are provided on the right and left sides of the standing deck 4*a*. The deck fins 4*a* are side walls protruding upward. The deck 4 is provided with a maintenance opening S (hatch). An outside region of the body 2 is in communication with the interior of the engine room R through the maintenance opening S. The opening area of the maintenance opening S is larger than the area of the engine 6 when viewed from above (in a plan view).

An engine hood 13 is removably mounted to the deck 4 in such a manner that the engine hood 13 covers the maintenance opening S from above. The engine hood 13 is provided with a seal member 14 which is sealingly attached to the peripheral edge portion of the maintenance opening S to prevent entry of the water from the outside region of the body 2 into the maintenance opening S. A hinge member 15 is secured to the upper surface of the deck 4 at a location that is in front of the maintenance opening S. The hinge member 15 includes a bottom wall 15*a*, a pair of side walls 15*b* protruding upward from the right and left ends of the bottom wall 15*a*, and a front wall 15*c* connected to the front end of the bottom wall 15*a* and the front ends of the pair of side walls 15*b*. The front end portion of the handle pole 16 is mounted to the pair of side walls 15*b* of the hinge member 15 in such a manner that the handle pole 16 is vertically pivotable around the front end portion thereof.

A bar-type steering handle 17, which can be steered by the rider, is attached on the rear end portion of the handle pole 16. A groove (not shown) is formed in a center portion of the upper surface of the engine hood 13 in the rightward and leftward direction and extends in the forward and rearward direction. The handle pole 16 is accommodated in the groove in a state in which the rider is not gripping the steering handle 17. The rider stands on the standing deck 4*a*, and grips the steering handle 17 to steer the personal watercraft 1 while raising the steering handle 17.

Figure 3:
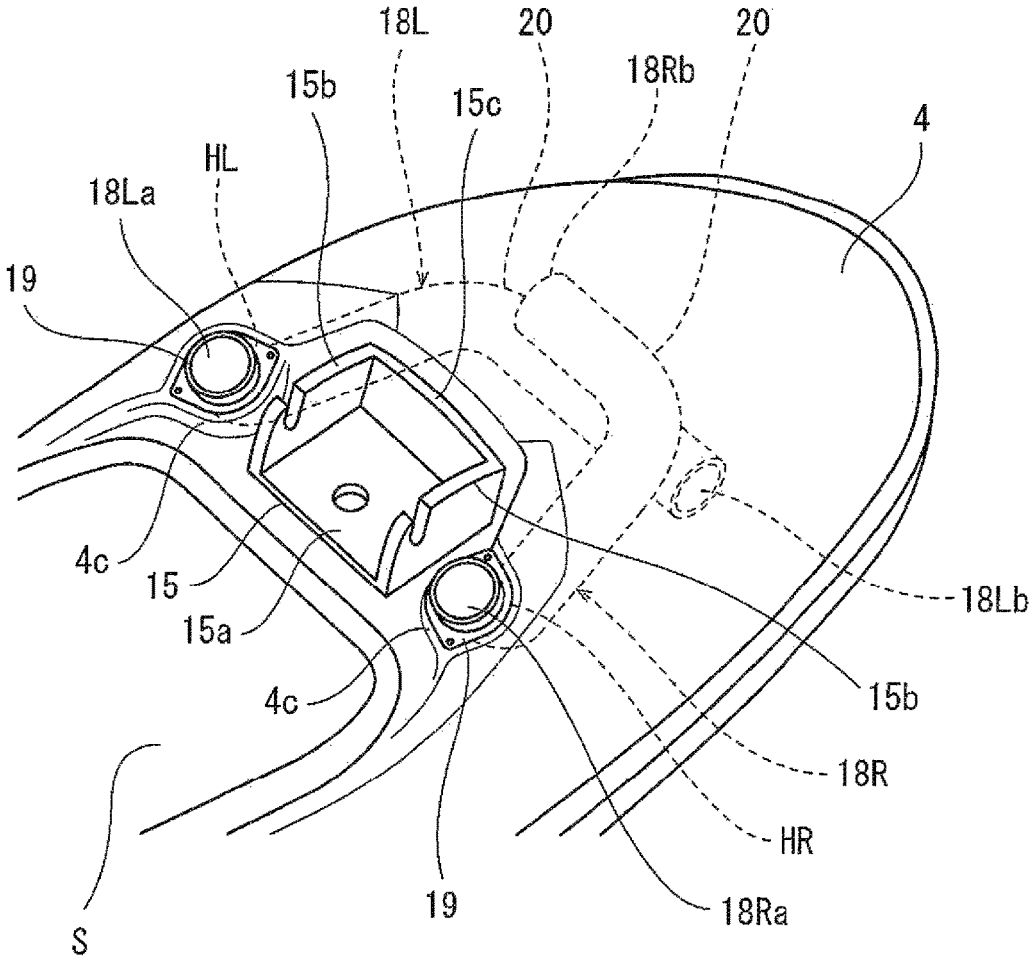
FIG. 3 is a perspective view showing the personal watercraft of FIG. 2, when the front portion of the personal watercraft is viewed obliquely from the right, the rear, and above.
Figure 4:
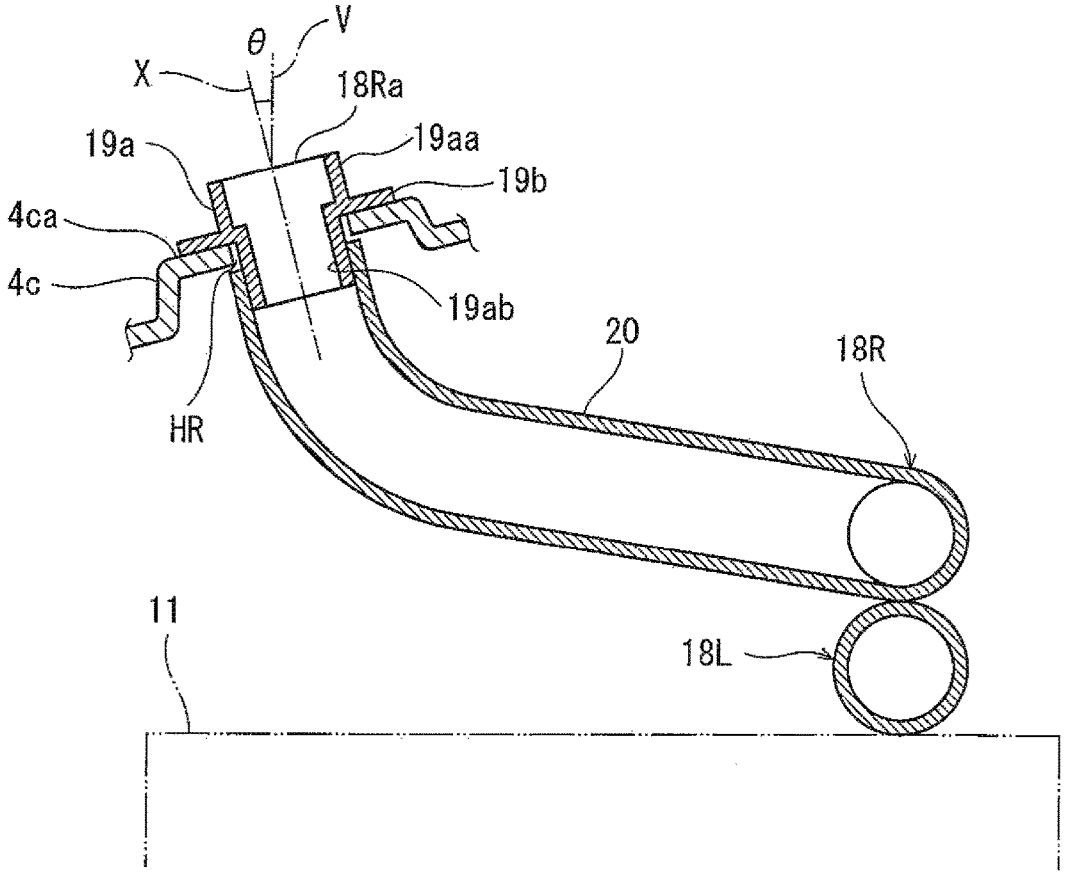
FIG. 4 is a cross-sectional view showing a ventilation duct of the personal watercraft of FIG. 3, and a region that is in the vicinity of the ventilation duct, when viewed from the right.

Referring to FIGS. 2 to 4, the deck 4 is provided with a pair of duct mounting holes HR, HL at locations which are different from the location of the maintenance opening S. The outside region of the body 2 is in communication with the interior of the engine room R through the pair of duct mounting holes HR, HL. Specifically, the pair of duct mounting holes HR, HL are disposed in front of the maintenance opening S and on the right and left sides of the hinge member 15. The pair of duct mounting holes HR, HL are disposed outside a region of the maintenance opening S which is surrounded by the seal member 14. When viewed from above (in a plan view), the seal member 14 extends through a region formed between the maintenance opening S and the pair of duct mounting holes HR, HL.

Ventilation ducts 18R, 18L are fitted to the duct mounting holes HR, HL, respectively. Air inlets 18Ra, 18La of the ventilation ducts 18R, 18L are disposed above the body 2. Air outlets 18Rb, 18Lb of the ventilation ducts 18R, 18L are disposed in the interior of the engine room R of the body 2. In this layout, the ventilation ducts 18R, 18L serve to guide the air from the outside region of the body 2 to the engine room R. The engine hood 13 does not cover the hinge member 15, and covers the air inlets 18Ra, 18La of the ventilation ducts 18R, 18L from above. A space is formed between the air inlets 18Ra, 18La of the ventilation ducts 18R, 18L, and the engine hood 13.

Each of the ventilation ducts 18R, 18L includes a flange member 19 mounted to the deck 4, and a tube member 20 connected to the flange member 19. In an exemplary configuration, the flange member 19 is made of a resin, while the tube member 20 is made of rubber. The flange member 19 of the ventilation duct 18R includes a tubular section 19*a* fitted to the duct mounting hole HR and a flange section 19*b* protruding outward from the outer peripheral surface of the tubular section 19*a*. The flange member 19 of the ventilation duct 18L includes a tubular section 19*a* fitted to the duct mounting hole HL and a flange section 19*b* protruding outward from the outer peripheral surface of the tubular section 19*a*. The tubular section 19*a* of the ventilation duct 18R includes an upper portion 19*aa* which protrudes upward to be higher than the flange section 19*b* and is provided with the air inlet 18Ra at an upper end thereof, and a lower portion 19*ab* which protrudes downward to be lower than the flange section 19*b* and to which the tube member 20 is fitted. The tubular section 19*a* of the ventilation duct 18L includes an upper portion 19*aa* which protrudes upward to be higher than the flange section 19*b* and is provided with the air inlet 18La at an upper end thereof, and a lower portion 19*ab* which protrudes downward to be lower than the flange section 19*b* and to which the tube member 20 is fitted. Each of the flange members 19 overlaps with the corresponding side wall 15*b* of the hinge member 15 when viewed from the side (in a side view). The upper end of each of the tubular sections 19*a* is located to be lower than the upper end of the corresponding side wall 15*b* of the hinge member 15.

When viewed from the side (see FIG. 1), the air inlets 18Ra, 18La of the ventilation ducts 18R, 18L are located above a boundary between the engine hood 13 and the deck 4. The air inlets 18Ra, 18La of the ventilation ducts 18R, 18L are located above the upper surfaces of portions of the deck 4, the portions surrounding the duct mounting holes HR, HL, respectively. The deck 4 is provided with swelling portions 4*c* protruding upward, on the right and left sides of the hinge member 15. The swelling portions 4*c* have upper wall portions 4*ca* provided with the duct mounting holes HR, HL, respectively. The flange section 19*b* of each of the flange members 19 is fastened to the deck 4 by use of a fastener member (e.g., rivet) in a state in which the flange section 19*b* is placed on the upper wall portion 4*ca* of the corresponding swelling portion 4*c*. The upper surface of the upper wall portion 4*ca* of each of the swelling portions 4*c* is inclined to extend rearward and downward. In this structure, an axis X of the tubular section 19*a* of the flange member 19 is inclined at a predetermined angle θ with respect to a vertical line V in such a manner that the upper end of the tubular section 19*a* faces rearward.

The tube members 20 are disposed in the engine room R in a state in which upper end portions 20*a* of the tube members 20 are connected to the lower portions 19*ab* of the tubular sections 19*a* of the flange members 19, respectively. Lower end portions 20*b* of the tube members 20 are provided with the air outlets 18Rb, 18Lb, respectively. The tube members 20 are disposed in the interior of the engine room R in a state in which they are curved in such a manner that the air outlets 18Rb, 18Lb are located in front of the engine 6 and the battery 10, and in front of the air inlets 18Ra, 18La, respectively. Since the ventilation ducts 18R, 18L are curved in a forward direction, a dimension of each of the ventilation ducts 18R, 18L in the forward and rearward direction is lamer than a Vertical dimension of each of the ventilation ducts 18R, 18L.

The pair of ventilation ducts 18R, 18L are symmetric in the rightward and leftward direction with respect to a center line C of the body 2 in the rightward and leftward direction, when viewed from above (in a plan view). Each of the tube members 20 is configured to have a L-shape when viewed from above. The tube member 20 of the left ventilation duct 18L is placed on the upper surface of the fuel tank 11. The tube member 20 of the right ventilation duct 18R is placed on the tube member 20 of the left ventilation duct 18L. The air outlets 18Rb, 18Lb of the pair of ventilation ducts 18R, 18L are located on the upper side of the front portion of the fuel tank 11. Alternatively, a vertical positional relationship between the right ventilation duct 18R and the left ventilation duct 18L may be reversed. That is, the tube member 20 of the left ventilation duct 18L may be placed on the upper side of the tube member 20 of the right ventilation duct 18R.

The air inlet 18Ra of the right ventilation duct 18R is located rightward relative to the center line C of the body 2, while the air outlet 18Rb of the right ventilation duct 18R is located leftward relative to the center line C of the body 2. The air inlet 18La of the left ventilation duct 18L is located leftward relative to the center line C of the body 2, while the air outlet 18Lb of the left ventilation duct 18L is located rightward relative to the center line C of the body 2. The air outlet 18Rb of the right ventilation duct 18R which is located leftward relative to the center line C opens leftward. The air outlet 18Lb of the left ventilation duct 18L which is located rightward relative to the center line C opens rightward.

In accordance with the above-described configuration, the duct mounting holes HR, HL are provided in the deck 4 at the locations, respectively, which are different from the location of the maintenance opening S. Therefore, the engine hood 13 can be demounted from and mounted to the deck 4 while maintaining a state in which the ventilation ducts 18R, 18L are mounted to the deck 4. This allows an operator to easily carry out a maintenance operation. In addition, since the air inlets 18Ra, 18La of the ventilation ducts 18R 18L are covered by the engine hood 13 covering the maintenance opening S, entry of the water from the outside region of the body 2 into the ventilation ducts 18R, 18L can be prevented effectively.

Since the air inlets 18Ra, 18La of the ventilation ducts 18R, 18L are located above the upper surfaces of portions of the deck 4, the portions surrounding the duct mounting holes HR, HL, respectively, entry of the water into the ventilation ducts 18R, 18L can be prevented effectively. Since the duct mounting holes HR, HL are disposed on the right and left sides of the hinge member 15, respectively, the air inlets 18Ra, 18La of the ventilation ducts 18R, 18L are isolated from each other by the side walls 15*b* of the hinge member 15. This makes it possible to effectively prevent a situation in which the water enters both of the pair of ventilation ducts 18R, 18L simultaneously.

The suction opening 9*a* of the air-intake passage P is disposed rearward relative to the engine 6, while the air outlets 18Rb, 18Lb of the ventilation ducts 18R, 18L are disposed in front of the engine 6 and in front of the air inlets 18Ra, 18La of the ventilation ducts 18R, 18L. In other words, the suction opening 9*a* of the air-intake passage P is located in the rear portion of the engine room R, while the air outlets 18Rb, 18Lb of the ventilation ducts 18R, 18L are located in the front portion of the engine room R. Therefore, the suction opening 9*a* of the air-intake passage P is distant from the air outlets 18Rb, 18Lb of the ventilation ducts 18R, 18L. In this layout, even when the air flowing into the engine room R through the ventilation ducts 18R, 18L contains plenty of moisture, this moisture is separated from the air while the air travels over a long distance from the air outlets 18Rb, 18Lb of the ventilation ducts 18R, 18L to the suction opening 9*a*, before the air is introduced into the suction opening 9*a* in the interior of the engine room R. This makes it possible to supply the air containing lesser moisture to the engine 6.

Since the tube members 20 of the ventilation ducts 18R, 18L are placed on the upper surface (upper side) of the fuel tank 11, a state in which the ventilation ducts 18R, 18L are curved can be maintained stably. Further, since the air inlets 18Ra, 18La of the ventilation ducts 18R, 18L open in a direction that is inclined rearward with respect to the vertical line V, entry of the water flying from a forward region into the air inlets 18Ra, 18La can be prevented. Moreover, since the axes X of the tubular sections 19*a* of the flange members 19 of the ventilation ducts 18R, 18L are inclined at the predetermined angle θ with respect to the vertical line V in such a manner that the upper ends of the tubular sections 19*a* face rearward, the air can be smoothly guided from the tubular sections 19*a* to the tube members 20, respectively, which are curved in the forward direction.

The invention claimed is:

1. A personal watercraft comprising:

a body including a deck and a hull, the body being provided with an engine room in an interior of the body;

an engine disposed in the engine room;

an engine maintenance opening provided in the deck and located above the engine in such a manner that an outside region of the body is in communication with an interior of the engine room through the engine maintenance opening;

a hinge member provided on the deck and located in front of the engine maintenance opening;

a handle pole mounted to the hinge member in such a manner that the handle pole is vertically pivotable;

at least one duct mounting hole provided in the deck at a location that is different from a location of the engine maintenance opening in such a manner that the outside region of the body is in communication with the interior of the engine room through the at least one duct mounting hole;

at least one ventilation duct fitted to the at least one duct mounting hole to guide air from the outside region of the body to the engine room; and an engine hood covering the engine maintenance opening and an air inlet of the at least one ventilation duct.

2. The personal watercraft according to claim 1, wherein the air inlet of the at least one ventilation duct is disposed above an upper surface of a portion of the deck, the portion surrounding the duct mounting hole.

3. A personal watercraft comprising:

a body including a deck and a hull, the body being provided with an engine room in an interior of the body;

an engine disposed in the engine room;

a maintenance opening provided in the deck and located above the engine in such a manner that an outside region of the body is in communication with an interior of the engine room through the maintenance opening;

at least one duct mounting hole provided in the deck at a location that is different from a location of the maintenance opening in such a manner that the outside region of the body is in communication with the interior of the engine room through the at least one duct mounting hole;

at least one ventilation duct fitted to the at least one duct mounting hole to guide air from the outside region of the body to the engine room; and an engine hood covering the maintenance opening and an air inlet of the at least one ventilation duct, wherein the at least one ventilation duct includes a flange member mounted to the deck, and a tube member disposed in the interior of the engine room in a state in which the tube member is connected to the flange member, wherein the flange member includes a tubular section fitted to the duct mounting hole and a flange section protruding outward from an outer peripheral surface of the tubular section, and wherein the tubular section includes a lower portion protruding downward to be lower than the flange section, and an upper portion protruding to be higher than the flange section and provided with the air inlet.

4. The personal watercraft according to claim 1, wherein the at least one duct mounting hole includes a pair of duct mounting holes, and wherein the pair of duct mounting holes are disposed on right and left sides of the hinge member, respectively.

5. A personal watercraft comprising:

a body including a deck and a hull, the body being provided with an engine room in an interior of the body;

an engine disposed in the engine room;

a maintenance opening provided in the deck and located above the engine in such a manner that an outside region of the body is in communication with an interior of the engine room through the maintenance opening;

at least one duct mounting hole provided in the deck at a location that is different from a location of the maintenance opening in such a manner that the outside region of the body is in communication with the interior of the engine room through the at least one duct mounting hole;

at least one ventilation duct fitted to the at least one duct mounting hole to guide air from the outside region of the body to the engine room;

an engine hood covering the maintenance opening and an air inlet of the at least one ventilation duct; and an air-intake passage which guides the air from the interior of the engine room to the engine, wherein a suction opening of the air-intake passage is disposed rearward relative to the engine in the interior of the engine room, and wherein the at least one ventilation duct is disposed in the interior of the engine room in a state in which the ventilation duct is curved in such a manner that an air outlet of the ventilation duct is located in front of the engine and in front of the air inlet.

6. The personal watercraft according to claim 5, further comprising:

a fuel tank disposed in front of the engine in the interior of the engine room, wherein the air outlet of the at least one ventilation duct is disposed on an upper side of the fuel tank.

* * * * *